US007160157B1

(12) United States Patent
Jones, III et al.

(10) Patent No.: US 7,160,157 B1
(45) Date of Patent: Jan. 9, 2007

(54) TWIST-LOCK TERMINAL CONNECTION SYSTEM

(75) Inventors: James Leroy Jones, III, Bellville, MI (US); James Dickinson Roberts, Royal Oak, MI (US); Joseph Paul Kalisz, Plymouth, MI (US); Kevin James Updike, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/377,542

(22) Filed: Mar. 17, 2006

(51) Int. Cl.
*H01R 11/11* (2006.01)

(52) U.S. Cl. ..... 439/883; 439/288

(58) Field of Classification Search ..... 439/288, 439/287, 286, 290, 883, 777, 779
See application file for complete search history.

(56) References Cited

U.S. PATENT DOCUMENTS

| | | | | |
|---|---|---|---|---|
| 2,977,567 A | | 3/1961 | Matthysse | |
| 3,316,522 A | * | 4/1967 | Demler, Sr. | 439/288 |
| 5,529,509 A | | 6/1996 | Hayes et al. | |
| 5,586,899 A | | 12/1996 | Okada | |
| 5,759,056 A | | 6/1998 | Costello et al. | |
| 5,834,696 A | | 11/1998 | Kurosawa et al. | |
| 5,865,638 A | * | 2/1999 | Trafton | 439/288 |
| 2006/0079138 A1 | * | 4/2006 | Zhao et al. | 439/883 |

* cited by examiner

*Primary Examiner*—Hien Vu
(74) *Attorney, Agent, or Firm*—Daniel R. Edelbrock

(57) ABSTRACT

An electrical terminal connection system includes first and second terminals that are interlocked by placing the first terminal on top of the second terminal and rotating the first terminal. The first terminal has a planar ring section with an outer perimeter and a centrally located aperture. The perimeter has cut-out portions. Inclined spring elements extend from the ring section near the outer perimeter. The second terminal includes a semi-circular part with an outer periphery and a centrally located collar. Curved walls extend perpendicularly from the outer periphery. The walls have ledges projecting over the semi-circular part. Aligning the cut-out portions of the first terminal with the curved walls and ledges of the second terminal enables the planar ring section of the first terminal to be placed on the semi-circular part of the second terminal, with the aperture receiving the collar. Rotating or twisting the first terminal causes the spring elements to contact and slide under the ledges. Simultaneously, a catch extending from the second terminal moves behind a locking edge formed in one of the cut-out portions of the first terminal as a side of the first terminal abuts against one of the curved walls. This prevents further rotation in either direction, maintaining the spring elements in physical and electrical contact with the ledges and interlocking the terminals. Depressing the catch enables reverse rotation and separation of the terminals.

17 Claims, 4 Drawing Sheets

TWIST-LOCK TERMINAL CONNECTION SYSTEM

BACKGROUND OF THE INVENTION

1. Field of the Invention

This invention relates in general to electrical terminals and more particularly to high current terminals that are engaged and then rotated relative to each other to interlock and complete an electrical connection.

2. Discussion of Related Art

A power distribution center or module (PDM) is commonly used in automotive vehicles to simplify and organize electrical system wiring. The PDM consolidates relays, fuses, branch circuits, connectors and other electrical components in a single location and eliminates multi-branch wiring. The typical PDM incorporates a bus bar or similar conductor into a housing. The housing often includes a surface having a plurality of receptacles for receiving the electrical connectors, fuses, relays and other circuit components. A PDM cover usually fits over the surface and insulates and protects the components. The bus bar is routed beneath the surface and has a plurality of blade-like projections that protrude into some or all of the receptacles to make electrical contact with the components when they are mounted on the surface. The bus bar supplies electrical power to the components for meeting the vehicle electrical circuit requirements. The electrical power is usually provided to the bus bar through a high current cable from the vehicle alternator and/or battery.

Often, in high power connections, an eyelet terminal is crimped or soldered on the end of the high current cable. The eyelet terminal fits over a threaded stud extending through the bus bar in the PDM, and a nut is used to tighten the eyelet terminal into electrical connection with the bus bar. Sometimes a separate bolt and nut are used to secure the terminal to the bus bar. In either system, a retention feature of this type requires tools, often with torque monitoring capabilities, to fasten the terminal to the bus bar. The use of tools provides opportunities for cross-threading or improperly torqued attachments that could cause loose connections. Inadequately tightened connections in turn could lead to overheating, electrical arcing, loss of contact and other undesirable events.

Co-pending, commonly owned U.S. patent application Ser. No. 11/204,033, filed Aug. 16, 2005, attempts to address some of these problems by using a manually operated lever to rotate a cam surface against a harness terminal. This forces the terminal against a bus bar extending from the PDM. The design of the cam surface along with a latch for the lever act to hold the terminal against the bus bar.

Other known designs require two individual terminals, one attached to the harness and the other separately attached to the bus bar, with an additional connector to maintain the interface between the two terminals. Some lower current grounding connections use terminals that can be locked together by engaging the terminals and twisting one terminal relative to the other, but still require fasteners to complete the connection. U.S. Pat. No. 5,759,056, for example, discloses identical eyelet terminals that have circumferentially spaced tabs formed on an inner edge of the eyelet. When one terminal is placed on top of the other and rotated, the tabs hook together and interlock the terminals in planar contact. A bolt is then passed through each eyelet to fasten the terminals to a grounding point.

SUMMARY OF THE INVENTION

Accordingly, it is an object of this invention to provide a reliable high current terminal connection system that doesn't require fasteners, such as bolts and nuts, or tools to complete the assembly, or additional connector components.

Another object of the invention is to enable positive interlocking and locking features to be implemented simply by twisting one terminal of the system relative to another terminal.

A further object of the invention is to increase the serviceability of the connection system by enabling easy, quick separation of the terminals.

In carrying out this invention in the illustrative embodiment thereof, a first terminal comprises a planar ring with a stem having crimp tabs for electrically attaching the first terminal to a wire harness. Deflectable elements extend upward from near an outer circumferential perimeter of the ring between cut-out portions on the perimeter. An aperture is located in a center area of the ring.

A second terminal is formed, for example, on the end of a power distribution module (PDM) bus bar and has a circular outer periphery. Folded-over members extending from the outer periphery create pockets or compartments over a surface of the second terminal. A resilient latch projection is located near the periphery between the folded-over members. A centrally located collar protrudes from the surface of the second terminal. The collar is sized slightly smaller than the aperture in the first terminal.

Orienting the first terminal above the second terminal with the cut-out portions aligned with the folded-over members and then inserting the collar of the second terminal through the aperture in the ring of the first terminal allows the planar ring of the first terminal to be placed on the surface of the second terminal. Twisting or rotating the first terminal then causes the deflectable elements to slide under the folded-over members into the compartments. When the deflectable elements are in the compartments, the latch projection of the second terminal snaps behind an edge of one of the cut-out portions of the first terminal, preventing reverse rotation. At the same time, the stem of the first terminal abuts against one of the folded-over members, preventing further forward rotation.

To separate the terminals, the latch projection is manually depressed and the first terminal is rotated in the reverse direction to remove the deflectable elements from the compartments. The cut-out portions of the first terminal are re-aligned with the folded-over members of the second terminal to enable the first terminal to be lifted off the second terminal.

The invention enables a reduction in labor needed during vehicle assembly of the harness and PDM terminals and elimination of some assembly tools such as wrenches or pneumatic drivers. No tools are required to directly assemble or mate the terminals. The required contact force is provided, and there is increased electrical contact surface area for higher reliability. One half of the interface is stamped as part of the bus bar, adding little or no cost because it would typically be scrap anyway. The first terminal can be stamped for essentially the same cost as a conventional eyelet terminal. The design is serviceable, and decreases costs overall since the terminal combination weighs less without fasteners and assembly time is reduced. A simple snap cap tethered to the module can be used to insulate the interface if required, or the interface can be insulated by an integral part of a PDM cover.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
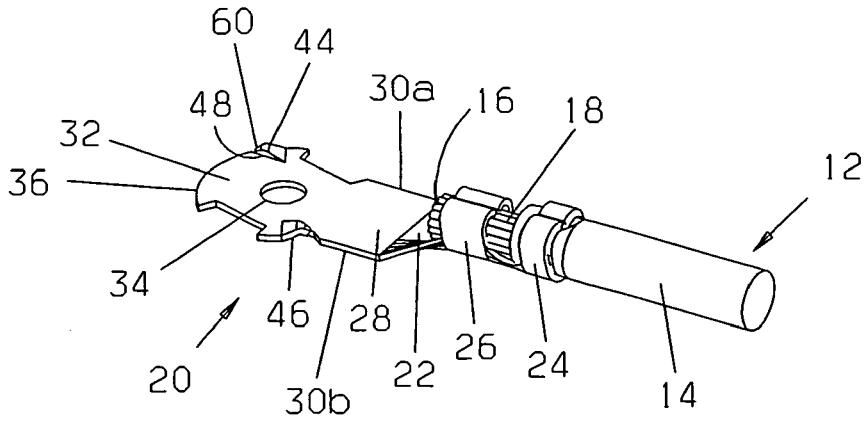
FIG. 1 is an isometric view of a harness-side terminal according to the present invention.
Figure 2:
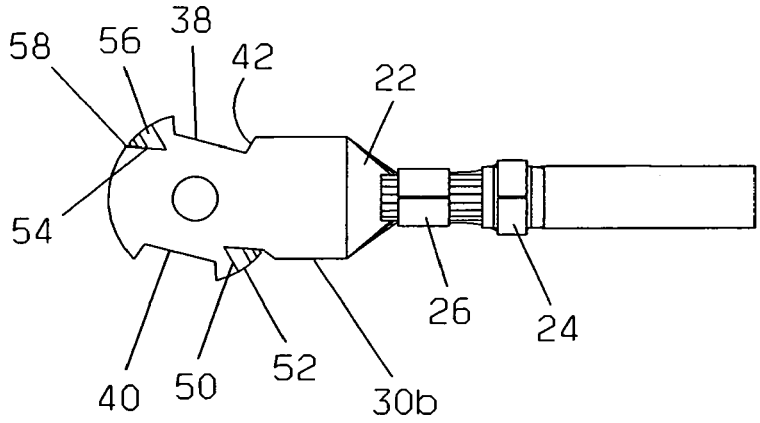
FIG. 2 is a top view of the harness-side terminal.
Figure 3:
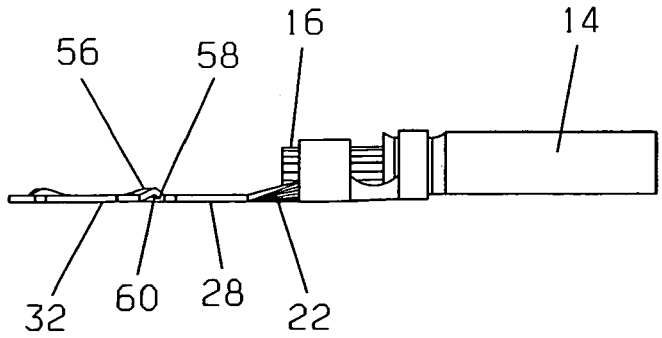
FIG. 3 is a side view of the harness-side terminal.

Referring now to FIGS. 1–3, a first or harness-side terminal of an electrical connection system, for attachment to a high power cable or wire harness 12, is illustrated. The harness has an insulative jacket 14 surrounding a conductor or conductors 16. The conductors 16 are exposed at an end 18 of the harness. A harness-side terminal 20 has a first, wire-connect section 22 including two sets of tabs. An outer set of tabs 24 is for crimping around the insulative jacket 14 of the cable or harness 12 to secure the terminal and harness together. An inner set of tabs 26 is for crimping around the exposed conductor 16 of the cable to make electrical contact between the wire and terminal. A relatively flat, straight second or stem section 28 of the terminal integrally extends from the wire-connect section. The stem section has two parallel, opposite sides 30*a* and 30*b* and makes an integral junction with a third, mating section 32.

The third or mating section 32 of the harness-side terminal 20 has the general configuration of a planar ring with an upper surface and an underside. The planar ring includes a central aperture 34 and an outer circumference or perimeter 36. The outer perimeter 36 is interrupted by two, three-sided cut-out portions 38 and 40 diagonally spaced across a width of the mating section 32 on an imaginary line through the central aperture 34. The cut-out portions each have two short sides of substantially equal length extending inward from the perimeter 36 and generally directed toward the aperture 34, and a long side connecting inner ends of the short sides. The long sides of the cut-out portions 38 and 40 are generally parallel to each other and arranged at a small angle relative to a longitudinal centerline of the terminal 20, as best seen in FIG. 2. One cut-out portion 38 is located immediately adjacent to the juncture between the stem section 28 (at side 30*a*) and the mating section 32. The other cut-out portion 40 is spaced a set distance along the perimeter 36 from the juncture of the second and third sections. The distance is determined by the aforementioned diagonal relationship between the cut-out portions. A short side of the cut-out portion 38 closest to the juncture between the second and third sections of the terminal forms a locking edge 42.

An outer peripheral area of the mating section 32 includes two deflectable spring elements 44 and 46 on the upper surface. The deflectable spring elements are also positioned diagonally across the width of the planar ring from each other on a line through the central aperture. One spring element 44 is located adjacent the perimeter 36 between the two cut-out portions but much closer to the cut-out portion 38. The other spring element 46 is located immediately adjacent to the juncture between the second, stem section 28 and the third, mating section 32, between the juncture and the spaced cut-out portion 40.

The spring elements 44 and 46 are each formed beginning with a straight, generally oblique slice 48 into the planar ring from the outer perimeter 36. Each element has a generally triangular outline with a base 50 joined to the ring and facing a cut-out portion 38 or 40. The spring elements each have two free sides, one side 52 coinciding with the outer perimeter 36 and the other side 54 with the slice 48. Each element is bent to form an inclined part 56 rising from a plane of the ring. A tip part 58 of the element is bent back down toward the plane of the ring in two segments to form a talon-like or hooked-shaped end 60, best illustrated in FIG. 3. The tip parts 58 of each spring element are near the perimeter of the planar ring and facing away from or distal from the adjacent cut-out portion.

Figure 4:
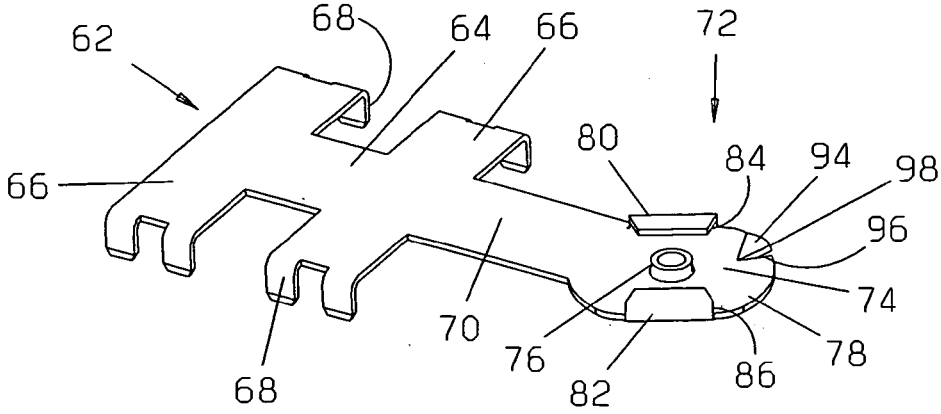
FIG. 4 is an isometric view of a bus-side terminal according to the present invention.
Figure 5:
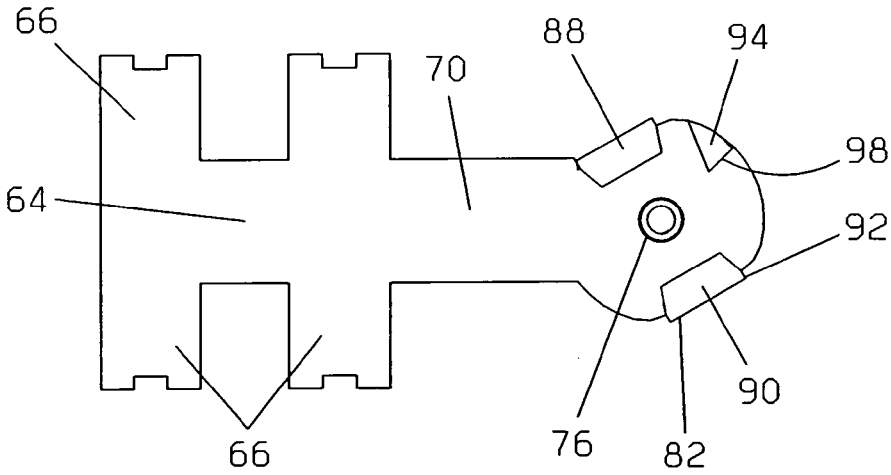
FIG. 5 is a top view of the bus-side terminal.
Figure 6:
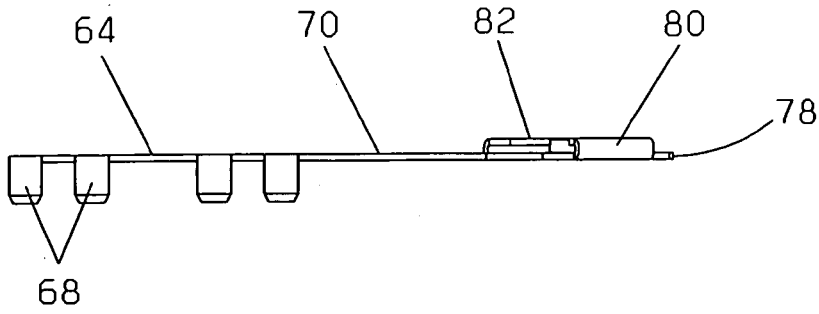
FIG. 6 is a side view of the bus-side terminal.

A second terminal of the connection system designed for assembly with the harness-side or first terminal 20 is illustrated in FIGS. 4–6. The second terminal extends from a bus bar 62. The bus bar 62 has a main part 64 with branched arms 66 in the same plane. Multiple contact blades or prongs 68 are bent at right angles to ends of the arms. A straight, flat elongated part 70 also extends from the main part 64. The component-side or bus-side second terminal 72 is formed at an end of the part 70 distal from the bus bar 62. The terminal 72 is an integral part 74 of the bus bar and has a generally oval or semi-circular shape. The semi-circular part 74 has a centrally located short tube or annular collar 76 raised or protruding above a focal plane or upper surface of the part. The collar 76 has an outer diameter that is slightly smaller than a diameter of the aperture 34 in the first terminal 20.

The second terminal 72 has an outer circumference or periphery 78 that includes two bent or folded-over members 80 and 82. The folded-over members are formed by bending protuberances from the periphery upward from the focal plane of the semi-circular part 74 and then back over into a plane parallel to the focal plane. Each folded-over member 80, 82 therefore provides a curved wall extending perpendicularly from the periphery. Compartments or passages 84 and 86 of relatively small height above the upper surface and along a portion of the periphery of the part 74 are formed under overhanging ledges or plates 88 and 90, respectively, extending radially inward from the curved walls of the folded-over members. The overhanging plates 88 and 90 are three-sided, corresponding in shape to the cut-out portions 38 and 40 of the mating section 32 of the first terminal 20 but slightly smaller in size. The folded-over members are positioned diagonally across a width of the semi-circular part 74 on an imaginary line through a center of the collar 76, with one member 80 being immediately adjacent to where the elongated part 70 of the bus bar joins with the part 74 and the other member 82 being spaced a distance from the part 70 diagonally across the part 74 from the member 80. The folded-over member 82 has a side 92 that will be utilized as an abutment or stop surface.

In addition, in the outer periphery 78 of the semi-circular part 74 of the second terminal 72, a resilient latch or catch 94 is formed between the two folded-over members. The catch 94 is located much closer to the folded-over member 80, and is inclined away from this folded-over member. The catch is formed by making a substantially radial cut 96 into the outer periphery 78 and then bending a segment of the material upward from the focal plane of the part 74 on one side of the cut 96, so that one side 98 of the cut provides a raised locking edge facing away from the folded-over member 80 and facing toward, along the circumference of the semi-circular part 74, the stop surface 92 of the folded-over member 82.

Figure 7:
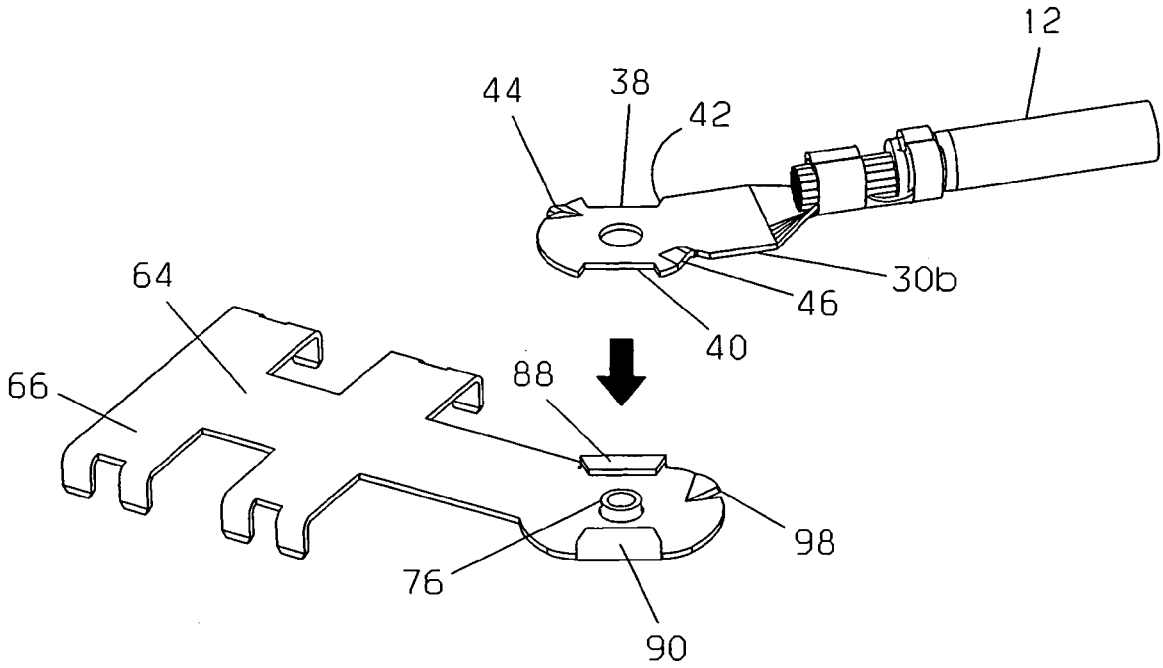
FIG. 7 is an exploded view illustrating the alignment of the harness-side and bus-side terminals prior to assembly.
Figure 8:
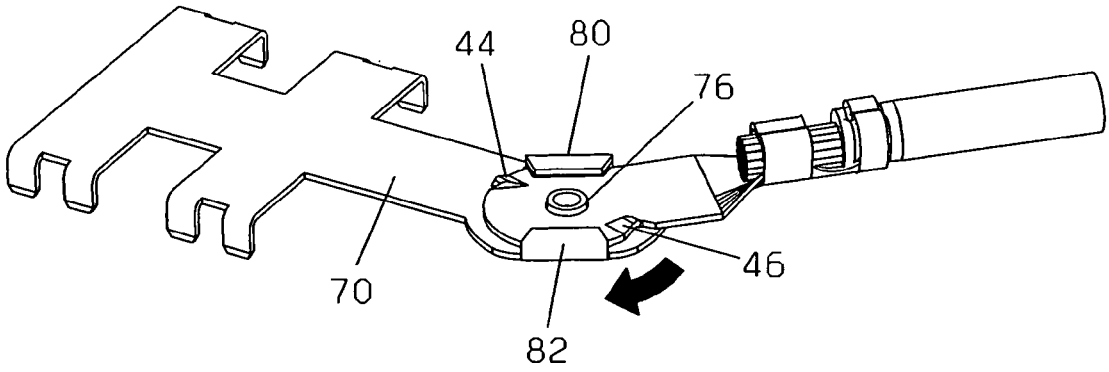
FIG. 8 is an isometric view showing the harness-side terminal rested on the bus-side terminal in an initial, unlocked position.
Figure 9:
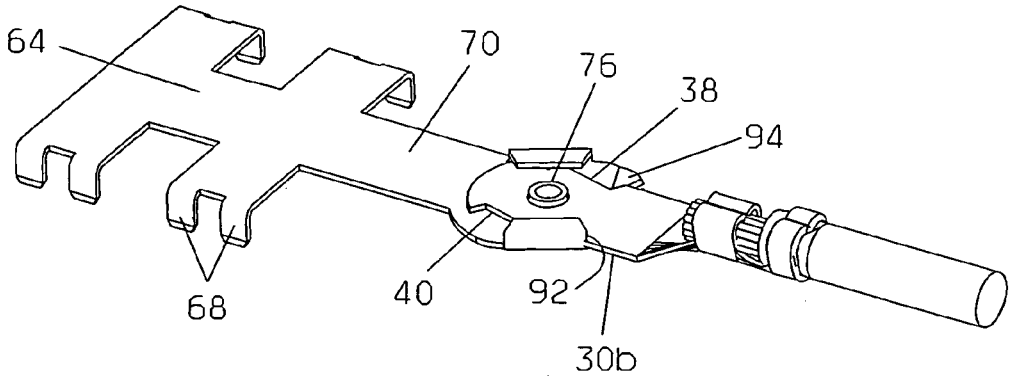
FIG. 9 is an isometric view of the terminals after they have been twisted or rotated to a final, interlocked position.

In the assembly of the electrical connection system according to the present invention, illustrated in FIGS. 7–9, the first terminal 20 is positioned over the second terminal 72. The cut-out portions 38 and 40 are aligned with the overhanging plates 88 and 90, respectively, of the folded-over members. The planar ring 32 of the first terminal is lowered onto the semi-circular part 74 of the second terminal (FIG. 7). The central aperture 34 in the planar ring of the first terminal 20 receives the collar 76 on the second terminal, as depicted in FIG. 8. The underside of the mating section 32 of the harness-side terminal rests upon the upper surface of the part 74 of the bus-side terminal. A longitudinal axis of the harness-side terminal would be at about a forty-five degree angle relative to a longitudinal axis of the bus-side terminal. However, this configuration is for illustration purposes only and the folded-over members and cut-out portions could be arranged at different locations to change the initial alignment angle.

Next, the harness-side terminal 20 is rotated or twisted clockwise to line up its longitudinal axis with the longitudinal axis of the bus-side terminal 72. This configures the bus bar and harness in a straight line. The interaction between the collar 76 and aperture 34 maintains the terminals in proper alignment as the terminal 20 is rotated. As the rotation occurs, the spring elements 44 and 46 deflect and slide under the folded-over members 80 and 82 respectively, flexing or flattening under the overhanging plates 88 and 90 into the compartments 84 and 86, respectively, to provide sustained reliable electrical contact between the elements and members. This also presses the terminals together to ensure electrical contact between the underside of the first terminal and the surface of the second terminal. The inclined parts 56 of the spring elements facilitate the deflection when the elements are forced against the plates.

The latch or catch 94 flexes downward under the pressed-down weight of the first terminal 20 until it rotates into the cut-out portion 38 simultaneously with the complete insertion of the spring elements into the compartments formed by the folded-over members. Then the resilient catch 94 snaps or moves back up (FIG. 9) such that its locking edge 98 contacts the locking edge 42 of the cut-out portion 38, preventing reverse or counter-clockwise rotation of the harness-side terminal 20. Also simultaneously, the side 30*b* of the stem section 28 of the harness-side terminal 20 abuts against the stop surface 92 of the folded-over member 82, preventing further forward or clockwise twisting or rotation. The terminals are securely interlocked with reliable electrical contact maintained over a significant amount of area including between the underside of the terminal 20 and the upper surface of the terminal 72, and between the spring elements 44 and 46 and the overhanging ledges or plates 88 and 90, respectively.

To separate the terminals and break the electrical connection, the catch 94 would be manually pressed back toward the focal plane of the bus-side terminal 72 beneath the plane of the harness-side terminal 20. The terminal 20 could then be twisted or rotated counterclockwise until the spring elements 44 and 46 leave the compartments 84 and 86 under the folded-over members 80 and 82, respectively. The downward-bent shapes of the tip parts 58 of the spring elements prevent significant obstruction with the folded-over members during this reverse rotation. The cut-out portions 38 and 40 eventually move into alignment with the folded-over members 80 and 82, respectively, and the terminal 20 can then be lifted off the terminal 72 to break the electrical connection.

Figure 10:
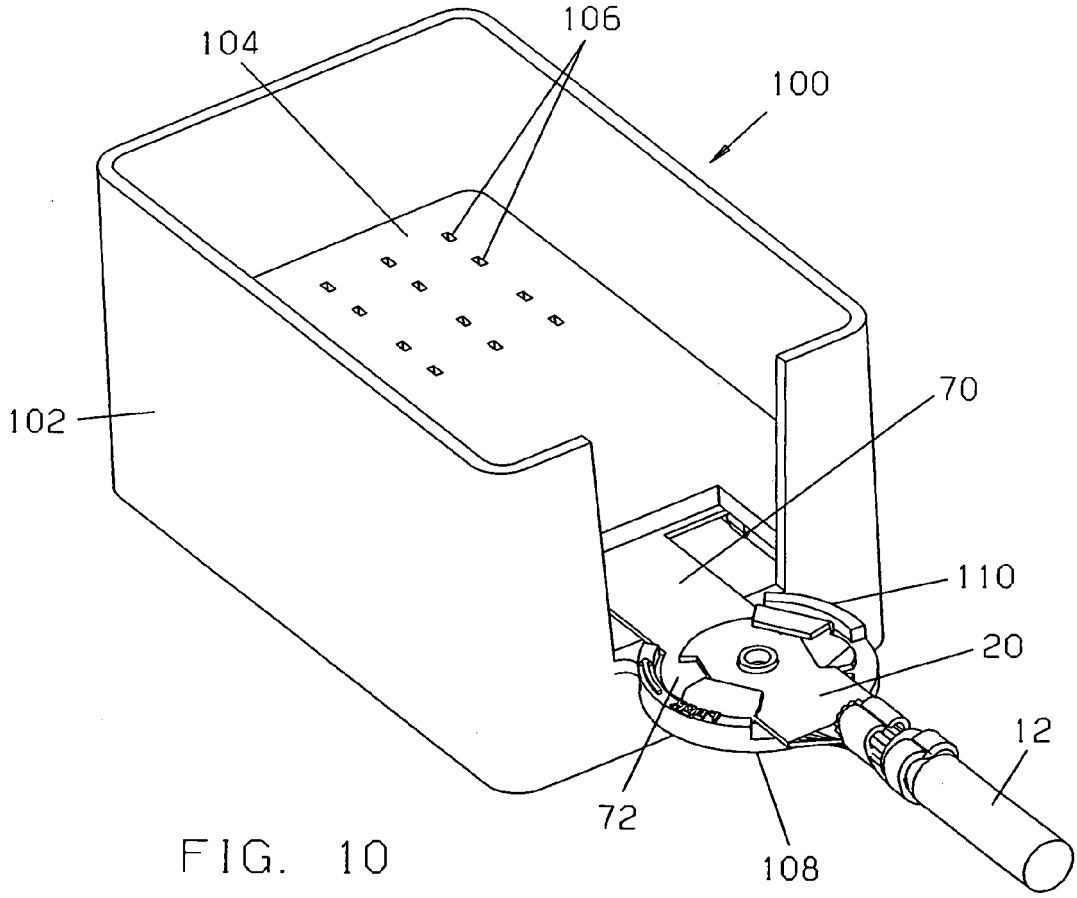
FIG. 10 is a perspective view of a power distribution module in combination with an electrical connection system formed by the harness-side and bus-side terminals of the present invention.

The electrical connection system formed by these terminals could be used in a variety of environments, including assembly with vehicle starters, alternators, motors or actuators with lead frames, grounding attachments, and battery terminals. FIG. 10 illustrates use of the terminal connection system with a power distribution module (PDM) 100. The PDM has an outer housing 102 and a horizontal inner surface 104 on which electrical devices (not shown) such as relays and fuses would be mounted. Receptacles 106 in the mounting surface 104 allow internal electrical connection between contacts extending from the electrical devices to the prongs or blades 68 of the bus bar 62. The bus bar distributes power to various electrical circuits routed through the electrical devices and the PDM from the high current cable 12. The second, bus-side terminal 72 would be supported on a plastic, non-conductive circular platform 108 projecting outward from the PDM housing 102. Short, curved walls 110 extending upward from the platform 108 help protect and stabilize the connection. The high power connection could be covered by a non-conductive cap tethered to the housing 102, or shielded by an additional cap feature formed on a conventional PDM cover, if required.

The terminals of this invention are easily manufactured. The terminals, for example, could be stamped, cut, bent and otherwise formed from 0.8 mm stock of brass. The cut-out portions, spring elements, folded-over members and catch could be positioned such that initial alignment angles in the general range of fifteen to ninety degrees are possible, depending on design requirements.

The wire connect section 22 of the terminal 20 could alternatively be configured with a double crimp arrangement for additional connection to a second wire harness. This would provide a current path from the terminal 20 to another load or power source. Examples would include current paths to both a battery and alternator, or to both a battery and power outlet. The bus-side terminal could be used with components other than bus bars, such as with various electrical appliances or on the end of a second wire harness.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical connection comprising:

a first terminal having deflectable elements with inclined parts and a locking edge near an outer perimeter of the first terminal;

a second terminal having members forming compartments for receiving and making electrical contact with the deflectable elements when the first terminal is placed on the second terminal and twisted a predetermined distance, the second terminal further including a latch for moving into position against the locking edge when the compartments receive the deflectable elements;

wherein the first terminal has a side arranged to abut against one of the members after the first terminal is twisted the predetermined distance, such that the side prevents further twisting while the latch and locking edge prevent reverse twisting.

2. The electrical connection of claim 1 wherein the latch is resilient such that the latch may be manually moved out of contact with the locking edge.

3. The electrical connection of claim 1 further including an aperture in the first terminal and a collar on the second terminal, the aperture and collar being positioned such that the aperture receives the collar when the first terminal is placed on the second terminal to maintain alignment between the terminals as the first terminal is twisted.

4. Interlocking electrical terminals comprising:

a first terminal having an outer perimeter with at least one raised spring element with an inclined part near the perimeter;

a second terminal having a surface with an outer periphery and at least one folded-over member extending from the outer periphery back over the surface to form a passage between the at least one folded-over member and the surface; and means for locking the terminals in an arrangement reached when the first terminal is placed on the surface of the second terminal and then rotated such that the at least one spring element is forced under the at least one-folded over member, the locking means comprising a resilient catch in the outer periphery of the second terminal and a locking edge extending inward from the perimeter of the first terminal; and an aperture centrally located on the first terminal and a collar centrally located on the surface of the second terminal, the aperture being sized to receive the collar to align the terminals prior to and during rotation.

5. The interlocking electrical terminals of claim 4 wherein the catch is formed by a segment of the second terminal being inclined upward from the surface.

6. The interlocking electrical terminals of claim 4 wherein the locking means further includes a side of the first terminal arranged to abut against one of the at least one folded-over members as the catch engages the locking edge, such that the first terminal then cannot be rotated in either direction.

7. The interlocking electrical terminals of claim 6 wherein the side of the first terminal is a side of a stem section of the first terminal extending to a wire-connect section.

8. The interlocking electrical terminals of claim 4 wherein there are two spring elements on the first terminal and two folded-over members on the second terminal, and further comprising two cut-out portions in the perimeter of the first terminal positioned such that as the first terminal is placed on the surface of the second terminal the folded-over members pass through the cut-out portions.

9. The interlocking electrical terminals of claim 8 wherein the cut-out portions and folded over members correspond in shape, with the cut-out portions being slightly larger in size to enable the folded-over members to pass through the cut-out portions.

10. The interlocking electrical terminals of claim 4 further comprising crimp tabs on the first terminal for electrically connecting the first terminal with a wire harness.

11. The interlocking electrical terminals of claim 4 wherein the second terminal is formed on an end of a bus bar secured within a power distribution module.

12. The interlocking eyelet terminals of claim 11 further comprising a platform extending from the power distribution module for supporting the interlocking eyelet terminals.

13. An electrical terminal connection system comprising:

a first terminal having a substantially planar ring with an upper surface, an underside, and an outer perimeter;

integral, deflectable elements extending from the upper surface of the first terminal near the perimeter of the first terminal, each of the deflectable elements having a part inclined relative to the upper surface of the first terminal;

a second terminal having a semi-circular part with an upper surface and an outer circumferential periphery; and integral members extending from the upper surface of the second terminal on the periphery of the second terminal, each member comprising a curved wall following the periphery, the wall having a radially inward directed ledge spaced above the upper surface of the second terminal;

wherein positioning the underside of the first terminal against the upper surface of the second terminal and rotating the terminals relative to each other slides the inclined parts of the deflectable elements on the first terminal under the ledges of the members on the second terminal to press the terminals together in electrical contact.

14. The connection system of claim 13 further comprising cut-out portions in the perimeter of the first terminal sized and shaped to enable the members of the second terminal to pass through the cut-out portions when the underside of the first terminal is positioned against the upper surface of the second terminal.

15. The connection system of claim 14 wherein one of the cut-out portions has a locking edge, and further comprising a latch on the outer periphery of the second terminal for engaging the locking edge when the deflectable elements are slid under the ledges to prevent rotation in an opposite direction.

16. The connection system of claim 15 further comprising a stem section on the first terminal, the stem section including a side for abutting against one of the members when the latch engages the locking edge, preventing further rotation in a same direction.

17. The connection system of claim 13 further comprising an aperture in the first terminal and a collar on the upper surface of the second terminal, the aperture being located to receive the collar when the underside of the first terminal is positioned on the upper surface of the second terminal.

* * * * *